US005794415A

United States Patent [19]

Huff et al.

[11] Patent Number: 5,794,415

[45] Date of Patent: Aug. 18, 1998

[54] APPARATUS FOR PACKING LAYERED FRUIT INTO BINS

[76] Inventors: Howard Huff, 377 E. Gleed Rd., Natches, Wash. 98937; Keith A. Kister, 1551 N. Del Rey, Sanger, Calif. 93657

[21] Appl. No.: 585,208

[22] Filed: Jan. 11, 1996

[51] Int. Cl.[6] ..... B65B 35/30

[52] U.S. Cl. ..... 53/475; 53/245; 53/259; 53/448; 53/535; 53/537

[58] Field of Search ..... 414/793.5, 793.8, 414/794.4; 53/244, 245, 247, 259, 447, 448, 475, 535, 537, 540

[56] References Cited

U.S. PATENT DOCUMENTS

| | | | |
|---|---|---|---|
| 3,488,917 | 1/1970 | Oswald et al. | 53/245 |
| 4,329,831 | 5/1982 | Warkentin et al. . | |
| 4,570,419 | 2/1986 | Tinsley . | |
| 4,600,065 | 7/1986 | Morris . | |
| 4,712,355 | 12/1987 | Dorner et al. . | |
| 4,875,327 | 10/1989 | Wilde . | |
| 4,965,982 | 10/1990 | Jesperson et al. . | |
| 5,159,796 | 11/1992 | Tas . | |
| 5,325,653 | 7/1994 | Boyd . | |
| 5,440,862 | 8/1995 | Sanchez-de-Leon-Rodriguez-Roda . | |
| 5,502,949 | 4/1996 | Main et al. | 53/245 X |
| 5,598,771 | 2/1997 | Main et al. | 53/259 X |

FOREIGN PATENT DOCUMENTS

| | | | |
|---|---|---|---|
| 217932 | 9/1925 | United Kingdom | 53/535 |

*Primary Examiner*—Daniel Moon

*Attorney, Agent, or Firm*—Klarquist Sparkman Campbell Leigh & Whinston, LLP

[57] ABSTRACT

An apparatus is disclosed for loading items, such as fruit, into a container such as a fruit bin with an open top face. The bin is transported on rollers to a tiltable cradle that grasps the cradle and tilts it to a loading orientation in which the bin face opens sideways. A wide endless belt conveyor positioned adjacent the cradle has a leading edge of the belt that shifts from a retracted position outside the container to an extended position projecting through the open face into the bin. The leading edge of the conveyor is retracted from the bin as the conveyor belt is running to deliver a horizontal layer of fruit from the conveyor surface into the bin. A height adjuster moves the cradle down (in the loading orientation) after the layer of items is delivered into the container, to provide clearance for delivering a subsequent layer of items from the conveyor. The leading edge of the conveyor is then extended again through the open face to deposit another horizontal layer of fruit on top of the layer that was already delivered. Extension and retraction of the conveyor is repeated until the bin is substantially filed with horizontal layers. Then the cradle is tilted away from the conveyor to return the bin to a transport orientation in which the open face of the bin is on top. The apparatus permits loading of fragile fruit into the bin with minimal damage to the fruit because the distance from the conveyor to the loading surface in the bin is minimized by adjustment of the bin height.

49 Claims, 5 Drawing Sheets

APPARATUS FOR PACKING LAYERED FRUIT INTO BINS

FIELD OF THE INVENTION

This invention relates to the packing of fruit, and more particularly to an automated apparatus for packing fruit in compact layers into a bin, while minimizing damage to the fruit.

BACKGROUND OF THE INVENTION

Fruits or other relatively fragile items are often packed into containers, such as fruit bins, for storage and shipment. Unfortunately, the fruit is often bruised or abraded as it is dropped through the open top of the bin into the container. Some fruit container filler machines have been designed that diminish this damage by reducing the height from which the fruit is dropped, or otherwise cushioning the impact of the fruit as it falls into the bin (for example by water delivery). Relatively gentle placement of the fruit into the bin is important because gentle handling avoids damaging the fruit and decreasing its market value.

For example, U.S. Pat. No. 5,440,862 discloses an automatic fruit bin filler chassis having a horizontal, continuous, retractable conveyor belt. Fruit is loaded on the retractable belt when the chassis in an elevated position above the top of the bin, and the chassis is then lowered through an open top of the bin until the belt is near the bin bottom. The belt is then retracted to drop the fruit on the floor of the container, or on top of a layer of fruit already on the container floor. After the layer of fruit is delivered, the endless belt is subsequently extended, and the carriage is lifted up out of the bin. More fruit is then introduced onto the retractable belt so that the cycle can be repeated. Although this device improves the delivery of fragile fruit in layers into the bin, it is inconvenient and unwieldy to repeatedly lift the chassis out of the bin to replace fruit on the retractable belt.

U.S. Pat. No. 5,159,796 shows a fruit bin which is held in an angular loading position, with the bin tilted on its side and the open face of the bin directed sideways. A horizontal, stationary endless conveyor belt extends through the open face of the bin to deliver fruit into the bin. A movable tongue extends beneath and receives fruit from the endless conveyor. The distance which the movable tongue projects beyond the leading edge of the running conveyor is varied depending on the weight of the container, or the level of the fruit therein. Extension of the tongue reduces the height of the drop distance into the container.

U.S. Pat. No. 4,965,982 discloses another apparatus for loading delicate fruit into bins. A pivoting cradle projects through the open top of a bin, and the cradle pivots across the floor of the bin to distribute fruit therein.

U.S. Pat. No. 4,329,831 discloses an apparatus having side-by-side packing heads, wherein the first packing head packs a lower layer of fruit, and the second packing head packs a top layer of fruit.

U.S. Pat. No. 4,570,419 shows a fruit receptacle having a triangular cross-section and an open top face through which fruit is delivered from a conveyor. A door parallel to the angled face moves up and down to regulate a flow of fruit from the conveyor into the receptacle. Once the receptacle is full, a hinged lower door of the receptacle swings open to fill a fruit container beneath the receptacle.

U.S. Pat. No. 4,600,065 describes an apparatus for filling containers with fruit through a fast filling chute, until the weight of the container reaches a preselected amount. The container is then moved to a slow filling chute, which more slowly fills the container with fruit until the desired container weight is achieved.

Other apparatuses for loading articles into a container are shown in U.S. Pat. No. 4,712,355; U.S. Pat. No. 4,875,327; and U.S. Pat. No. 5,325,653.

In spite of numerous efforts to devise convenient fruit packing devices that minimize damage to the fruit, an adequate solution to this problem has not been found. Water delivery can cause undesirable water permeation of the fruit. Many of the other prior delivery devices have used complex and costly machines to lower the fruit through an open top of the container, or produce an unacceptable incidence of damage to the fruit.

It is therefore an object of the present invention to provide an apparatus for loading items, such as delicate fruit, into a container while minimizing damage to the fruit that can impair its market value.

Yet another object of the invention is to provide such a device that is both effective for this purpose, yet relatively efficient.

Yet another object of the invention is to provide such a device that can economically operate at a high capacity.

These and other objects of the invention will be understood more clearly by reference to the following detailed description and drawings.

SUMMARY OF THE INVENTION

The foregoing objects are achieved by providing an apparatus for loading items, such as fruit, into a container having an open face. The apparatus includes a wide endless belt conveyor having a leading edge of the conveyor belt that is moved between an extended position and a retracted position by a belt moving mechanism. A container cradle accepts the container in a loading orientation, in which the open face of the container is directed upward. The cradle tilts the container to a loading orientation, in which the open face opens to the side.

With the container in the loading orientation, the leading edge of the conveyor is extended through the open face from outside the container. Rows of fruit are delivered from the continuous belt of the conveyor and deposited in a layer, as the belt movement mechanism retracts the leading edge of the moving belt conveyor. A height regulator subsequently incrementally moves the cradle down after the leading edge is retracted, to provide clearance for subsequent extension of the leading edge of the conveyor, and deposition of another layer of fruit as the leading edge of the conveyor is again retracted.

The invention also includes a method of loading items, such as fruit, into a container having an open face through which the items are to be loaded in sequentially deposited layers. An endless belt conveyor is provided that has a leading edge of the moving belt that moves between an extended position and a retracted position. The container is positioned in a loading orientation with the open face of the container directed to the side, and the leading edge of the conveyor is extended from outside the bin through the open face of the bin into the container to an item delivery position. Items are then delivered from rows on the conveyor into the bin by retracting the leading edge of the conveyor as the endless belt moves, to deposit a layer of the items in the container from the leading edge of the conveyor as it is retracted. The delivered layer is preferably a single layer on a side well of the bin that surrounds the open face.

The method further includes the step of lowering the container (in the loading orientation) relative to the conveyor after forming the layer of the items, then again extending the leading edge of the conveyor to the item delivery position. Another layer of items is then delivered into the container on top of the layer of items already delivered therein. Retraction, delivery of the fruit layer, repositioning of the container and extension of the conveyor are repeated until the bin is filled.

Other embodiments of the invention include tilting the container from a transport orientation (with the open face on top) to the loading orientation (with the open face on the side) prior to inserting the conveyor through the open face. After loading, the container is then tilted back to the transport orientation for storage and shipment. Some embodiments of the invention also include incrementally covering the open face of the container as it is loaded to prevent the horizontal layers of fruit in the container from rolling out through the open face.

DETAILED DESCRIPTION OF A PREFERRED EMBODIMENT

Figure 1:
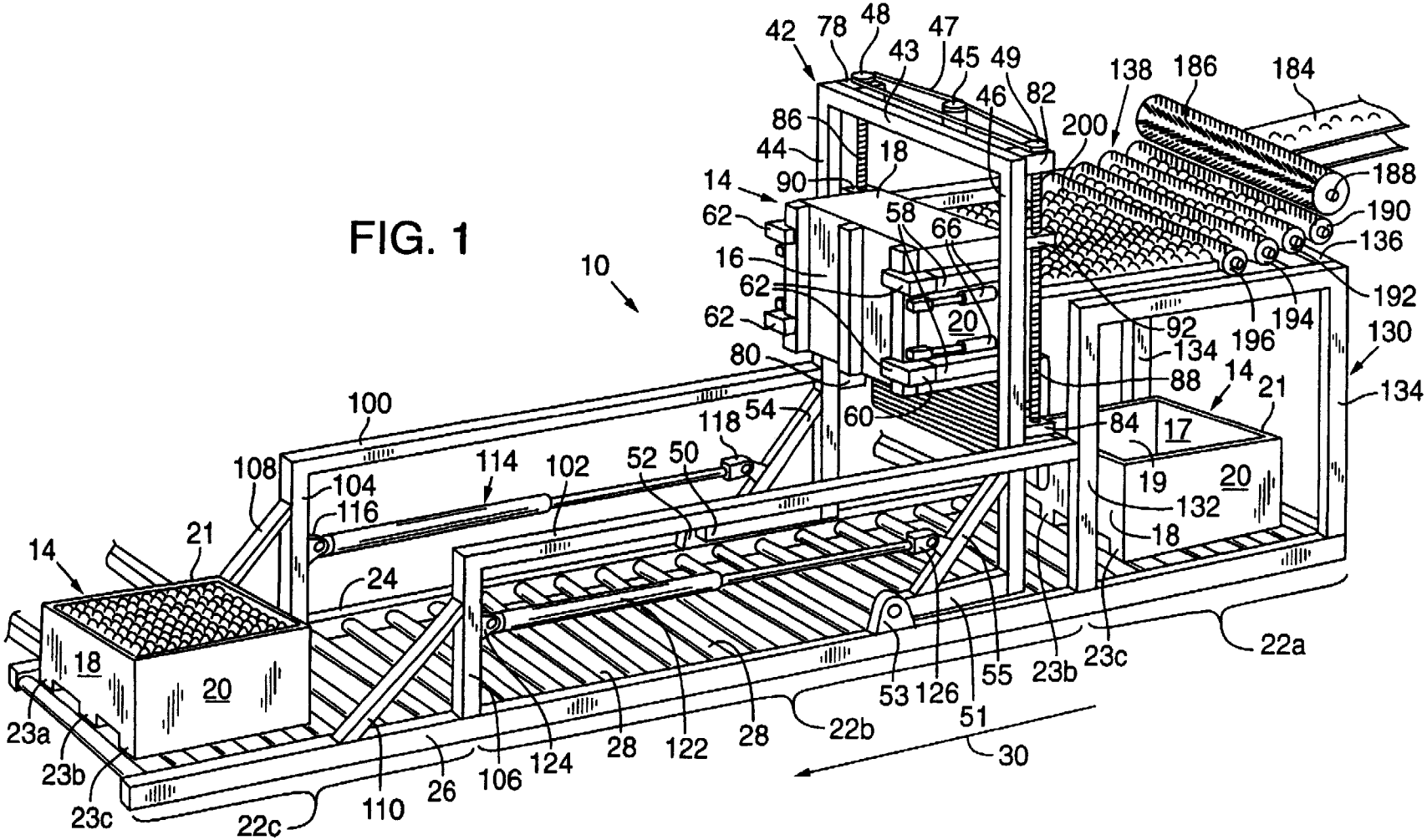
FIG. 1 is a perspective view of the loading apparatus of the present invention, showing the container, in a cradle, tilted up to a loading orientation from which fruit is delivered from an endless conveyor into the open face of the container.

An apparatus 10 for loading fruit 12 (such as apples 200) into fruit bins 14 is shown in the drawings. As best shown in FIG. 1, each bin a container having a square or rectangular, flat, solid bottom 16 with front wall 17, rear wall 18, and side walls 19, 20 perpendicular to the bottom 16. The bin walls have flat inner surfaces that collectively form a cube shaped bin enclosure having a square or rectangular cross-section. Bin 14 has a square or rectangular open top face defined by a continuous top edge 21 of adjoining walls 17, 18, 19, 20. Three parallel, rectangular beams 23*a*, 23*b*, 23*c* extend across the length of an exterior face of bottom 16 between walls 17 and 18 to elevate bin 14 over a bin conveyer surface 22 on which the bin sits. The bin conveyor surface in this specific disclosed embodiment is the plane formed by the aligned top surfaces of rollers 28, on which beams 23 ride.

The bin conveyor 22 includes a pair of parallel side rails 24, 26, between which extend a plurality of the spaced steel rollers 28. The rollers are mounted to roller bearings in rails 24, 26 such that rollers 28 have parallel rotational axes transverse to parallel rails 24, 26. Bin 14 moves in a direction of movement 30 (FIG. 1) along conveyor 22 from an upstream section 22A, to a bin cradle section 22B, to a downstream section 22C. The bin in upstream section 22A is in a transport orientation, in which the bin opens upwardly. The beams 23 on the bottom surface of bin 14 move along rollers 28 to transport the bin to cradle section 22B, where the bin is tilted through 90° to a loading orientation in which the bin opens sideways. After the bin is loaded, it is tilted back down to the transport orientation, whence it moves on rollers 28 to downstream section 22C.

Figure 2:
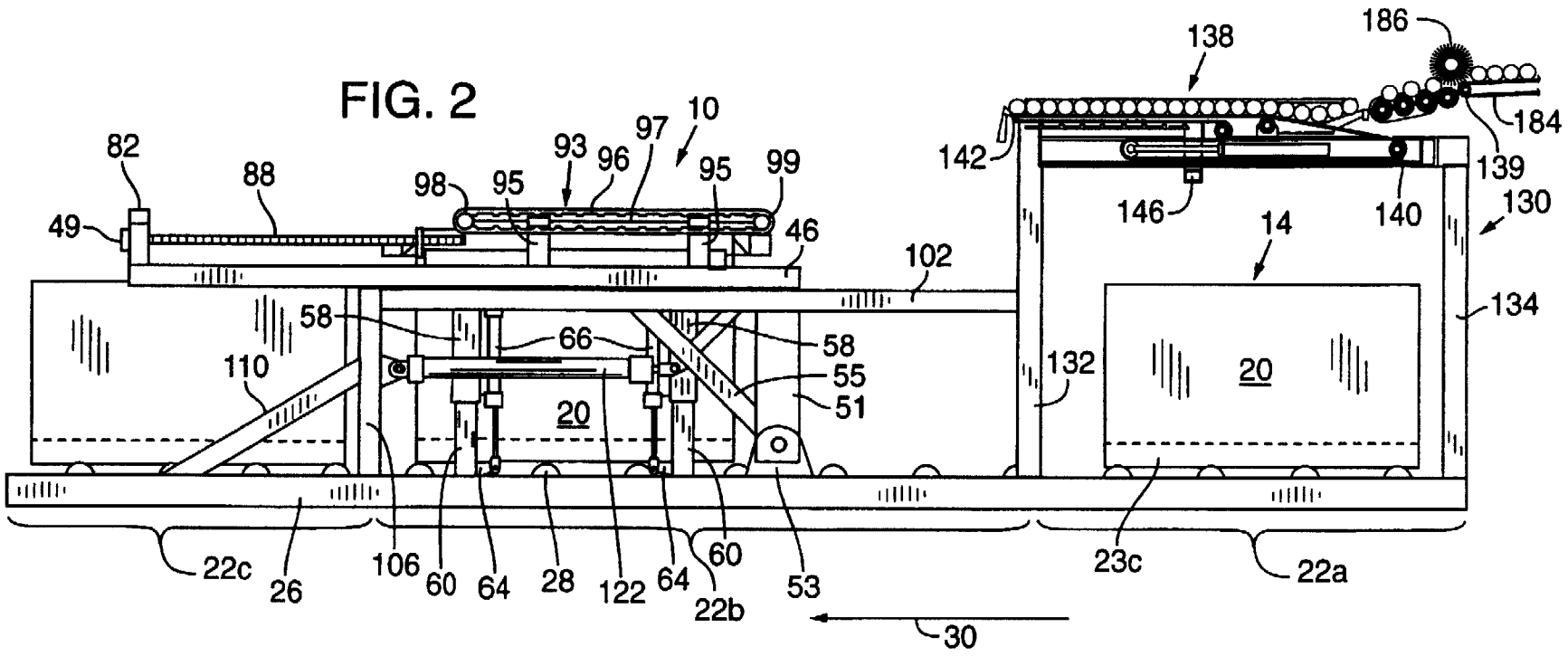
FIG. 2 is a side elevational view of the apparatus shown in FIG. 1, but with the container held in the cradle in the transport orientation, before the container is tilted up.

A bin cradle 40 (FIG. 4) is suspended above conveyor section 22B by a U-shaped cantilevered frame 42 (FIGS. 1 and 3) having elongated parallel side bars 44, 46 that are substantially parallel to side rails 24, 26 of conveyor 22 when the cradle is in a bin receiving position, as shown in FIG. 2. A cross bar 43 (FIG. 1) extends between side bars 44, 46 to complete the U-shaped frame, and a motor 45 is mounted on cross bar 43 to drive an endless belt 47. The belt 47 is journalled around a pair of drive pulleys 48, 49 to drive an externally threaded shaft described below.

The open end of the cantilevered frame 42, that is not closed by cross bar 43, is mounted to conveyor 22 by a pair of parallel legs 50, 51 which extend perpendicularly from the forward end of side bars 44, 46. A free end of each leg 50, 51 is pivotally attached to pivot plates 52, 53 by a pivot pin extending between the plates and through the free end of each leg. A cross brace 54 extends between the leg 50 (near pivot plate 52) to an intermediate portion of side bar 44 (between cross bar 43 and the free end). A similar cross brace 55 extends between the leg 51 (near pivot plate 53) to an intermediate portion of side bar 46. Legs 50, 51 hold U-shaped brace 42 in a cantilevered, pivoting position above the conveyor 22. Cross braces 54, 55 preferably extend at an angle of about 45 degrees to respective legs 50, 51 and side bars 44, 46.

Figures 3, 4:
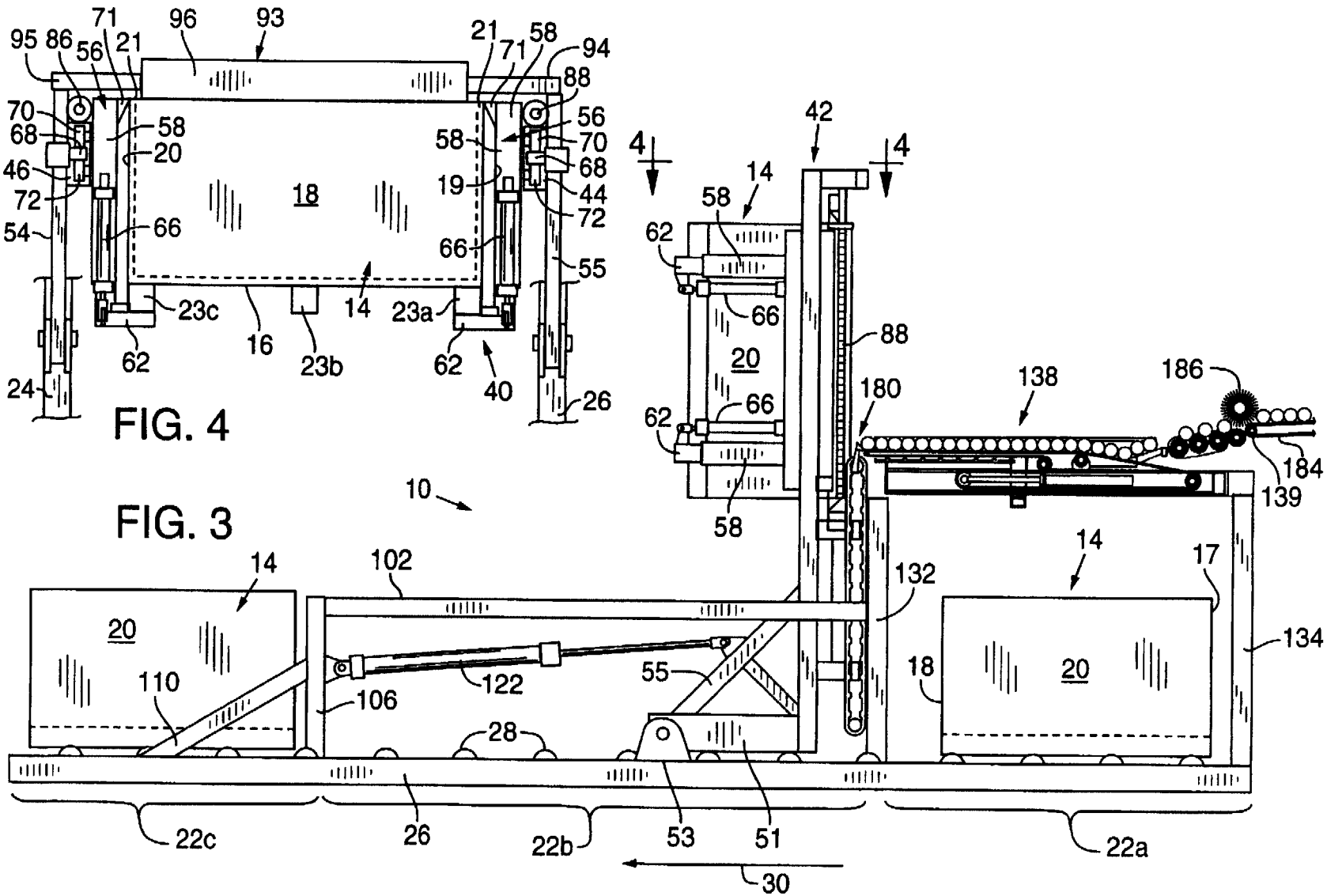
FIG. 3 is a view similar to FIG. 2, but showing the bin tilted up to the loading orientation shown in FIG. 1.
FIG. 4 is an enlarged, end elevational view of the cradle holding the bin in FIGS. 2 and 3.

Bin cradle 40 carried by frame 42 is shown in greater detail in FIGS. 1, 2 and 4 to include two pairs of opposing, downwardly extending arms 56 that are spaced wide enough to receive bin 14 therebetween. Each arm is telescopic, having a stationary segment 58 and a retracting segment 60 (FIG. 2). Segment 60 has smaller dimensions than segment 58, such that the segment 60 slides into and out of segment 58 for extending and retracting arms 56.

Each retracting segment 60 is a right angle shaped member with a retractable portion that slides within segment 58, and a finger 62 that extends perpendicular to segment 60. The fingers 62 have flat upper surfaces, project towards each other, and are small enough to fit between adjacent rollers 28 underneath bin 14. Each retracting segment 60 is attached through a lift joint 64 (FIG. 2) to an hydraulically operated piston and cylinder assembly 66 which, when actuated to retract the piston, raises retracting segment 60. Similarly, extension of the piston exerts a force through joint 64 to extend segment 60.

A rectangular wedge frame 68 (FIG. 4) is positioned at the top of the arms 56, on stationary segment 58 to engage the bin 14 and hold it tightly in cradle 40 when arms 56 are retracted. The rectangular frame 68 has a continuous inclined face V71 which positions and frictionally engages the container as the container is lifted in the cradle.

Cradle 40 slides within frame 42 to adjust a loading position of the bin. The sliding mechanism is best shown in FIG. 4, wherein the side bars 44, 46 are seen to be inwardly open, C-shaped channels having a track 68 extending longitudinally through each channel. Each arm 56 has a pair of top and bottom rollers 70, 72 that tightly engage the track 68 and roll along the track to shift the position of the cradle longitudinally within U-shaped frame 42. An elongated externally threaded rotatable shaft 86 (FIG. 1) is fixed between opposing bearing members 78, 80 on frame 42 such that the shaft extends parallel to and above side bar 44. Shaft 86 is driven by drive pulley 47 on bearing member 78. A second, elongated, rotatable externally threaded shaft 88 extends between bearing members 82, 84. Shaft 88 is driven by drive pulley 49 on member 82. A drive nut 90 (FIG. 1) is provided around threaded shaft 86, while another drive nut 92 is provided in threaded engagement around stud 88. Each of nuts 90, 92 is connected to bin cradle 40 such that rotation of shafts 86, 88 by drive pulleys 48, 49 moves drive nuts 90, 92 to slide cradle 40 along rails 68 of side bars 44, 46.

A bin cover 93 is provided over cradle 40 (see FIGS. 2–4). The bin cover 93, which is stationary relative to frame 42, is mounted to frame side bars 44, 46 by braces 94, 95 (FIG. 4) that project toward cover 93 and suspend it between and in a plane parallel to and above side bars 44, 46. Cover 93 includes a movable endless belt 96 (for example, made of plastic interlocking, articulated belt segments) that travels around a flat plate 97 (FIG. 2) that is held substantially parallel to and spaced above cradle side bars 44, 46 by braces 94, 95. Transverse edges of plate 97 are rounded to provide smooth bearing surfaces 98, 99 over which belt 96 rides. Belt 96 is free to rotate around plate 97 when fruit frictionally engages the surface of belt 96, to help minimize relative movement between fruit in the container and the cover as the cradle slides the bin within the frame.

A stationary frame is mounted on conveyor 22 surrounding cantilevered frame 42. The stationary frame includes elongated side beams 100, 102 (FIG. 1) which are parallel to side bars 44, 46, and legs 104, 106, which extend perpendicularly from side beams 100, 102 to conveyor side rails 24, 26. Legs 104, 106 are slightly shorter than pivot legs 50, 51 of the cantilevered frame 42, so that the stationary frame encloses the cantilevered tilting frame. Reinforcing braces 108, 110 extend at an angle of about 45 degrees between legs 104, 106 and conveyor side rails 24, 26 to provide additional structural support for the stationary frame.

Side beams 100, 102 are longer than cradle side bars 44, 46, and extend the length of conveyor cradle section 22B. A hydraulically actuated piston and cylinder assembly 114 extends between leg 104 and pivot brace 54 of cantilevered frame 42, with pivotal attachments 116, 118 at each end of the assembly 114. Similarly, an hydraulically actuated piston and cylinder assembly 122 extends between leg 106 and pivot brace 55, with pivotal attachments 124, 126 at each end of the assembly 122. Assemblies 114, 116 can be simultaneously actuated to exert force through pivotal attachments 118, 126 against braces 54, 55 to tilt up the cantilevered frame.

A conveyor support frame 130 is provided over upstream conveyor section 22A. The frame includes a pair of forward legs 132 (only one of which is shown in FIG. 1) which are approximately twice as high as pivotal legs 50, 51 and legs 104, 106. A pair of rearward support legs 134 support the rear of frame 130, and are the same height as legs 132. A U-shaped frame 136 is supported above and in a plane parallel to conveyor side rails 24, 26. The frame 136 supports a fruit conveyor 138, which is described in greater detail below.

Fruit conveyor 138 (FIGS. 5 and 6) is substantially as wide as, but fits through, the open face of bin 14 parallel to front and rear bin faces 17, 18. Conveyor 138 is extendable through the bin opening to a fruit delivery initiation position shown in FIG. 6, and is retractable to a cradle repositioning position shown in FIG. 5. The conveyor includes a plurality of rollers that extend between opposing arms of U-shaped frame 136. The rollers include a stationary rearward drive roller 140, which extends between the parallel arms of frame 136, and a small diameter movable forward roller 142 at the forward edge of a conveyor plate 144. The conveyor plate is a thin, solid member which is secured to and moves with a movable C-shaped bracket 146 that extends above and below a horizontal, forwardly directed arm of U-shaped frame 136. Bracket 146 is moved along the side arm of frame 136 by a rotatable, externally threaded shaft 147 that extends from stationary motor **147*a* through an internally threaded cylindrical opening in bracket 146**.

Figure 5:
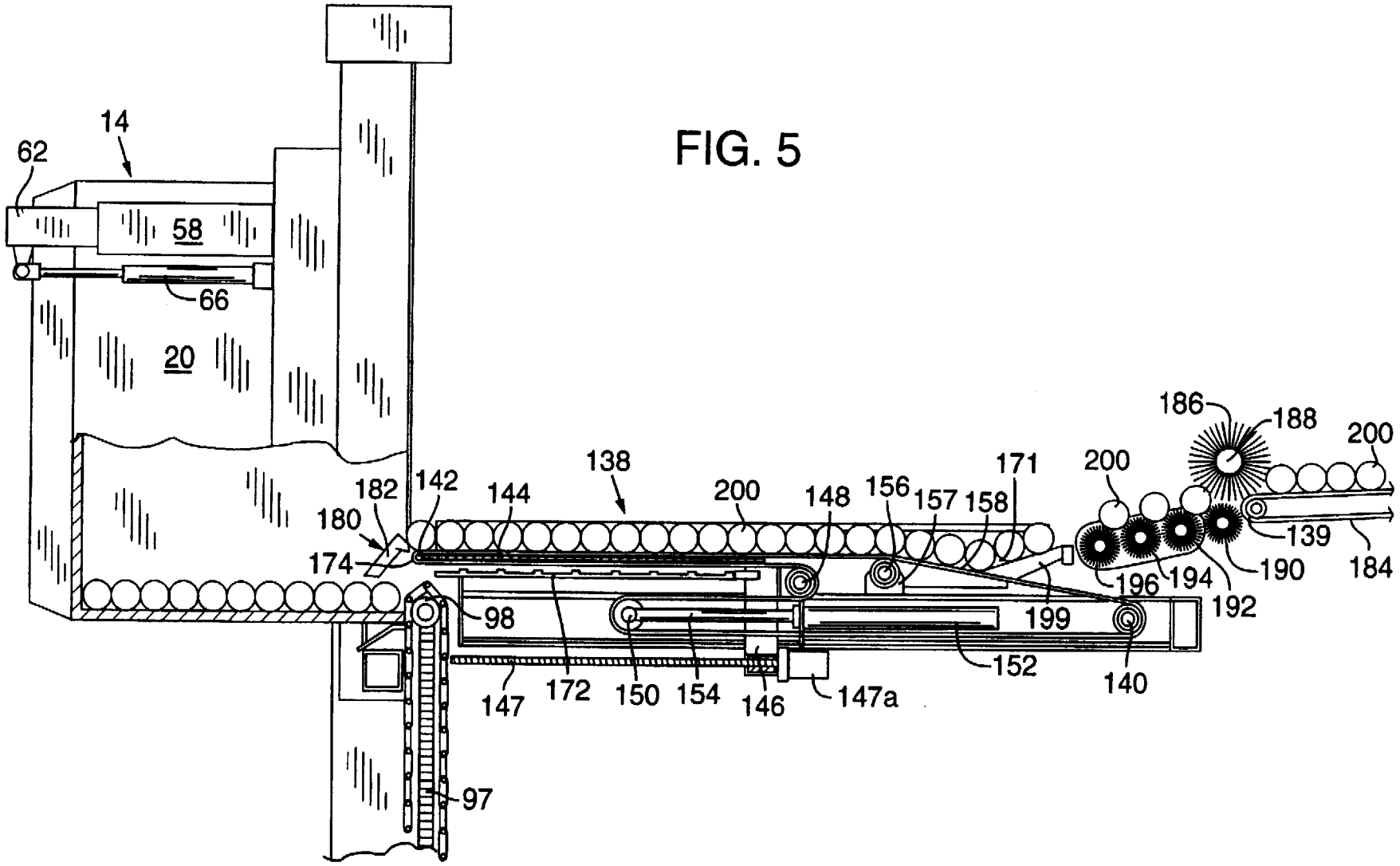
FIG. 5 is an enlarged, side elevational view of a loading portion of the apparatus of FIG. 3, showing the relationship of the extendable conveyor and fruit bin before the leading edge of the conveyor has been extended through the open face of the bin.
Figure 6:
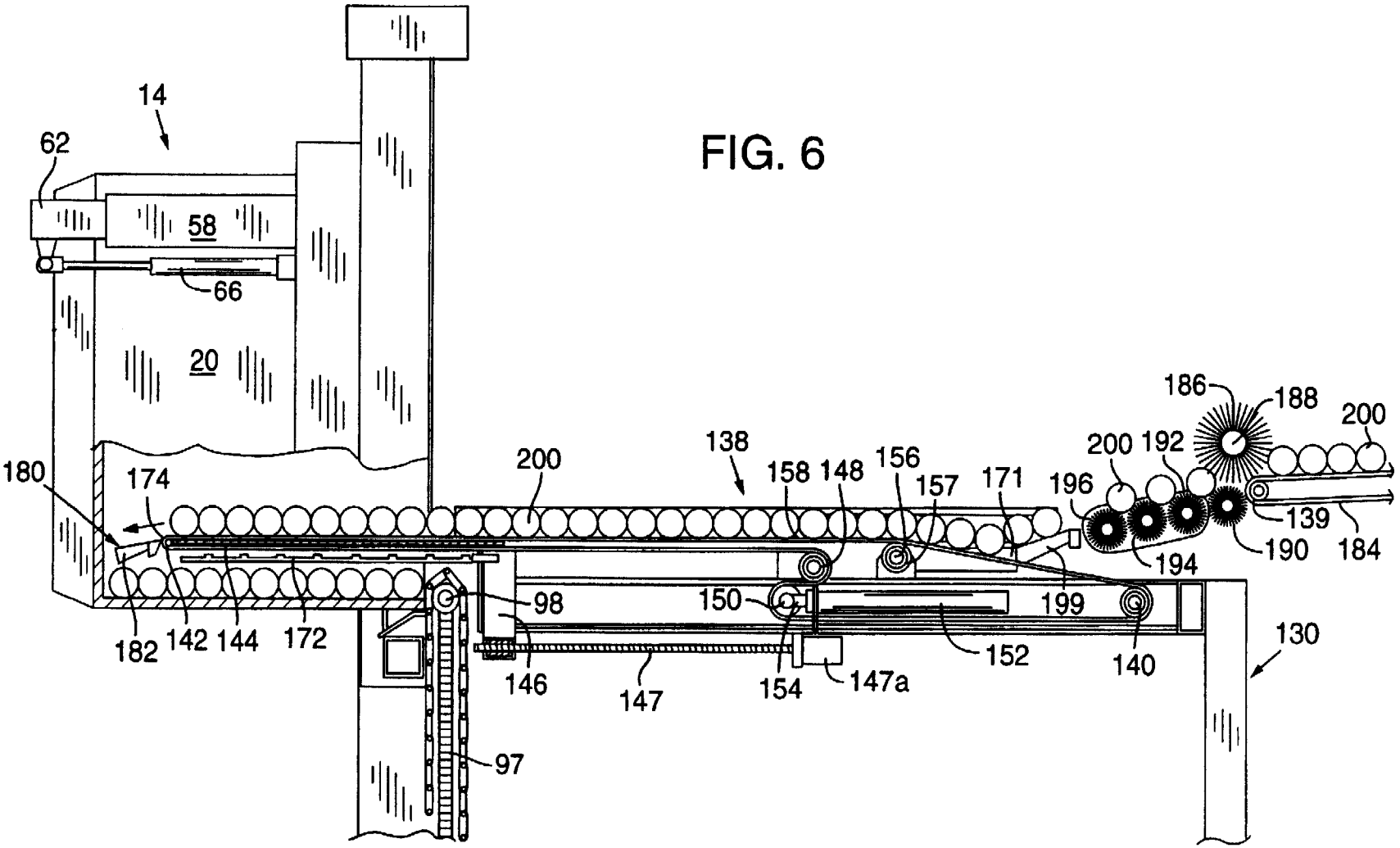
FIG. 6 is a view similar to FIG. 5, but showing the leading edge of the conveyor extended to deliver fruit through the open face of the bin.

Conveyor 138 further includes a stationary intermediate roller 148 mounted above frame 136 but below roller 142. A movable intermediate roller 150 extends almost completely across the distance between the parallel arms of frame 136. Roller 150 is a tensioning roller that is carried between a pair of air pressure piston and cylinder assemblies 152 (only one of which is shown in FIGS. 5 and 6). Each of the assemblies 152 has a piston 154 (FIG. 5) extending parallel to the parallel arms of frame 136. The tips of the pistons engage and suspend opposing ends of the roller 150. Assembly 152 maintains a constant piston pressure, so that roller 150 functions as a tensioning roller that maintains a constant tension in a conveyor belt rolling around it. Conveyor 138 further includes a positioning roller 156 that is mounted on a bracket 158 above frame 136. Roller 156 is positioned slightly higher than intermediate roller 148, with the top of roller 156 at the same level as plate 144 and the top of forward roller 142.

A plastic endless belt conveyor 170 travels around the rollers as shown in FIGS. 5 and 6. The conveyor belt extends over the top and front of forward roller 142, thence back in a substantially horizontal orientation to intermediate roller 148. The belt is wrapped over the top and back of roller 148 to change direction and head in a substantially horizontal orientation toward tensioning roller 150. The belt then moves over tensioning roller 150, and changes direction at that roller to extend substantially horizontally back to rearward roller 140, whence belt 170 extends up and over positioning roller 156, then forward over plate 144 to roller 142.

The transport surface 158 of conveyor 138 extends upward at an angle from drive roller 140 to positioning roller 156, thence substantially horizontally forward to roller 142. The angled portion of the transport surface 158 provides a trough 171 (FIGS. 5 and 6) into which fruit is delivered to help spread the fruit transversely across the moving transport surface of the conveyor belt. The horizontal portion of the transport surface 158 between rollers 156 and 142 can be extended and retracted by advancing and retracting the roller 142. Hence roller 142 (and associated plate 144) is a conveyor belt movement mechanism contained within the moving belt for advancing and retracting a leading edge 174 of the belt that bends around roller 142.

A pressure sensitive plate 172 underneath the forward portion of conveyor 138 spans substantially the area between movable roller 142 and movable bracket 146 when the conveyor is in the retracted position shown in FIG. 5. Plate 172 is fixed to a top arm of movable C-shaped bracket 146, and held substantially parallel to plate 144, such that movement of bracket 146 by rotation of shaft 147 moves pressure sensitive plate 172 in tandem with movable conveyor plate 144. Plate 172 is a conventional pressure transducer that senses pressure against the plate and sends out a signal when pressure against the plate exceeds a preselected level (for example, two ounces of pressure).

A fruit loading regulator barrier 180 extends along the entire length of the leading transverse edge 174 of the conveyor 138. Barrier 180 is a brush 182 that is mounted to a pivot rod (not shown) extending parallel to and in front of roller 142. The pivot rod moves with conveyor plate 144 to remain in position at the leading edge of the conveyor as the conveyor is advanced and retracted. Brush 182 pivots between an upright position (shown in FIG. 5) in which a portion of the brush extends above the conveyor surface to separate the fruit and block fruit delivery from transport surface 158, and a substantially horizontal position (best shown in FIG. 6), in which a top surface of the brush is substantially parallel with or slightly sloped down from the transport surface 158 of conveyor 138.

A separate, conventional, endless belt fruit delivery conveyor 184 (FIGS. 1, 5 and 6) delivers fruit to conveyor 138 from a leading edge 139 of the conveyor. A fruit delivery speed regulating brush 186 is mounted on a cylindrical roller 188 that extends along and slightly above the leading edge 139 of conveyor 184, and the roller 188 is driven to rotate brush 186 in a clockwise direction (as seen in FIGS. 1 and 5) to regulate the entry of fruit from conveyor 184. Brush 186 rotates at a speed that slows down fruit delivered from conveyor 184, so that the fruit can be spread transversely across the conveyor. Brush 186 has fine bristles that extend substantially perpendicular to roller 188.

A series of four sequential, aligned fruit distributing brushes 190, 192, 194, 196 (FIGS. 5 and 6) extend from the leading edge 139 of conveyor 182 toward trough 171. Each of the sequential brushes is positioned at a successively lower level to gradually incline toward trough 171 of conveyor 138. Each of brushes 190, 192 has bristles that are directed at an angle from left to right in the direction of fruit movement from conveyor 184 to conveyor 138. Each of brushes 194, 196 has bristles that are oriented in rows angled from right to left in the direction of fruit movement from conveyor 184 to conveyor 138. Hence fruit that moves across brushes 190, 192 is directed at an angle to the right, while fruit that moves over brushes 194, 196 is directed at an angle to the left. The net effect of these four distributing brushes 190, 192, 194, 196 is to laterally distribute fruit from narrow conveyor 184 into wide trough 171 which extends transversely the width of conveyor 138. An elongated transfer brush 199, made of flexible bristles, presents a resilient inclined transfer surface that spans the distance between roller 196 and transport surface 158 of conveyor belt 170. The flexible fingers of the brush ride against belt 170 to prevent fruit from falling below the brush, and cushion delivery of the fragile fruit from brush 196 to transport surface 158.

In operation, bin 14 is placed on conveyor 22 at section 22A (FIG. 1), and rollers 28 are rotated to move bin 14 in its upright transport orientation from section 22A to cradle section 22B. As bin 14 moves into the cradle section of the conveyor, it rolls over cradle fingers 62 (which are positioned between the rollers), to the position shown in FIG. 2. Assemblies 66 are then actuated to lift fingers 62 by telescoping segment 60 into arms 56, and elevating bin 14 (in the transport orientation) several inches above rollers 28 to provide more clearance for subsequently tilting the bin. Bin elevation also brings top edge 21 of the bin into tight engagement with the inclined surface 70 of rectangular frame 68 (FIG. 4) that extends around the top of the bin to hold the bin tightly in cradle 40 as the cradle subsequently tilts.

Pivot assemblies 114, 122 are then actuated to extend their pistons, which tilts cradle frame 42 from the bin receiving position shown in FIG. 2 to the bin loading position shown in FIG. 3. With this tilting, bin 14 is moved to a loading orientation in which walls 17, 18 are substantially horizontal and the open face of the bin faces sideways. Threaded shafts 86, 88 are then rotated by actuating motor 45 to drive belt 47. Rotating shafts 86, 88 raise cradle 40 and bin 14 vertically away from rollers 28 toward the top cross bar 43 of cantilevered frame 42, with the cradle in the tilted up position shown in FIG. 3.

The leading edge 174 of conveyor 138 (which has been in the retracted position of FIG. 5) is then extended by motor **147*a* rotating threaded shaft 147 clockwise to shift bracket 146 from the retracted position shown in FIG. 5 to the extended position shown in FIG. 6. (Extension of the conveyor may occur simultaneously with tilting up the cradle and/or sliding the cradle within the cantilevered frame to position the bin.) Movement of bracket 146 shifts plate 144 and roller 142 forwardly, to extend the leading edge of conveyor 138 into the open face of bin 14, with plate 144 and transport surface 158 substantially parallel to bin wall 17. Threaded shafts 86, 88 are then rotated clockwise again to raise bin 14 in the cantilevered frame until pressure sensitive plate 172 senses contact with wall 17 of the bin. Contact between the pressure sensitive plate 172 and bin wall 17 sends a signal to a controller (not shown) which reverses motor 45 and rotates threaded rods 86, 88 counterclockwise to lower the bin cradle and bin a predetermined distance (for example, one-quarter to one-half inch) to provide a clearance to deliver fruit in a layer on horizontal side wall 17 of the bin. The distance between the transport surface 158 of the conveyor, from which the fruit is delivered, to the inner surface of the bin wall 17** is small enough that the fruit is not damaged by being delivered from this height. Although a clearance of one-quarter to one-half inch between the conveyor surface and bin wall is preferred, distances ranging from one-quarter inch to twelve inches could, for example, less preferably be employed.

After bin 14 has moved down to establish the clearance between the leading edge of the conveyor and the wall 17 of the bin, or simultaneously with downward movement of the bin, barrier brush 182 shifts from its upright blocking position (FIG. 5) to its flat delivery position shown in FIG. 6. Flattening of the barrier allows fruit, such as apples 200, to be delivered from the already moving conveyor belt 170 into a layer on the inner surface of bin side wall 17. Concurrently with the change in position of the brush, bracket 146 is shifted back by rotation of shaft 147 to smoothly retract bracket 146, attached plate 144 and forward roller 142. As the leading edge 174 of the conveyor is retracted in this manner, tensioning assembly 152 maintains a constant pressure against belt 170 such that tension in the belt remains constant as the leading edge is retracted. Hence piston 154 of the tensioning assembly is gradually retracted as leading edge 174 is extended, to maintain constant tension in the conveyor belt.

Bracket 146 is preferably moved to retract leading edge 174 at a speed proportional to or the same as the rate at which fruit is delivered from the slightly elevated transport surface 158 of the conveyor, such that rows of fruit from the conveyor are delivered in a substantially uniform layer of fruit on horizontal bin wall 17 as the conveyor retracts. The height from which the fruit is gently delivered from the retracting conveyor is small enough to greatly reduce loading damage to the fruit. When the conveyor has retracted a predetermined distance, a single layer of fruit **200*a* has been deposited on the interior surface of wall 17 of the bin, the layer preferably stopping at top edge 21 of bin 14. The barrier brush 182 then pivots back to its upright position in which it blocks the further delivery of fruit from conveyor belt 170, which continues to move around the conveyor rollers as the conveyor is subsequently extended. The conveyor surface movement may be stopped by stopping drive roller 140** if the conveyor is not being extended during the bin lowering step described below.

Bin 14 is then incrementally moved down a predetermined distance such as a predetermined apple height plus 1–2 inches by again rotating threaded shafts 86, 88 counterclockwise to move cradle 40 down. The leading edge of the conveyor is then once again extended through the open face of the bin to the fully extended position, either as the bin is incrementally lowered, or immediately thereafter. Bin 14 is then raised with cradle 40 until the top of the layer of fruit in the bin contacts pressure sensitive plate 172, at which time a signal is sent from the pressure transducer to a controller (not shown) to again lower the bin a predetermined distance that provides a clearance for delivering fruit, without allowing the fruit to fall through such a distance that it would be bruised or otherwise damaged. The leading edge of the belt is then again retracted to deposit a new single layer of fruit on top of the existing layer of fruit in the bin. This new layer of fruit is, like the subjacent layer, substantially parallel to bin side wall 17.

After the layer of fruit is delivered, barrier brush 192 pivots to its upright blocking position to stop the delivery of fruit from the conveyor. Extension and retraction of the belt, with incremental downward movement of the cradle, is repeated until sequential layers of fruit fill the bin to a preselected height. This preselected height is preferably the height of the open face of the container 14 through which the conveyor is introduced.

As the bin 14 is filled and incrementally moves downward, the open face of the bin is preferably covered to prevent the horizontal rows of fruit from rolling out of the bin. The stationary bin cover 93 is provided for this purpose to incrementally cover the top of the cradle and the open face of the bin as the bin is shifted down. The endless plastic belt that forms the surface of the cover will move when frictionally engaged by fruit, to neutralize relative movement between the fruit and cover surface as the bin incrementally moves down, thereby diminishing bruising or abrasion of the fruit. The top edge of the cover is maintained at a height sufficient to retain within the container layers of fruit already deposited therein. Yet the top edge of the cover is low enough to provide clearance for extension of the conveyor into the bin. The top edge of the cover 93 is preferably maintained at about the same level as the top layer of the fruit already in the conveyor at the time the conveyor is extended into the container for delivery of a subsequent layer of fruit.

When the bin reaches its lowermost position in its tilted loading orientation, the open face of the bin is completely covered by bin cover 93. The piston of pivot assemblies 114, 122 are then retracted to tilt cantilevered frame 42 and cradle 40 from the upright, bin loading position of FIG. 3, back to the cradle position shown in FIG. 2. Assemblies 66 are then actuated to extend their pistons and lower fingers 62, which allows the beams 23 on the bottom 16 of the bin to be deposited back on rollers 28. After fingers 60, 62 move back down between rollers 28, the rollers are activated to move bin 14 out of the cradle to the downstream conveyor section 22C. Another bin can be simultaneously or sequentially conveyed from upstream conveyor section 22A into the cradle, so that the loading process can be repeated again with another bin.

The method of the present invention includes loading fruit or other (often fragile) items in layers in a bin through an open side face of the bin that is incrementally covered as each layer is deposited. The open face is preferably substantially vertical, and fruit is deposited in layers on a horizontal wall of the bin, but the face is preferably at an angle of 0–45 degrees to a vertical plane. Similarly, the flat wall of the container on which the fruit is delivered is at an angle of 45–90 degrees to the vertical plane. More preferably the face is 0–10 degrees to the vertical, and the bin wall 17 is substantially horizontal (e.g., 0–10 degrees to the horizontal).

Although a rectangular bin is shown as the container in the disclosed embodiment, containers of different shapes may be used.

Having illustrated and described the principles of my invention with reference to a preferred embodiment, it should be apparent to those persons skilled in the art that such invention may be modified in arrangement and detail without departing from such principles. I claim as my invention all such modifications as come within the true spirit and scope of the following claims.

I claim:

1. An apparatus for loading items into a container having an open face, comprising:

an endless belt conveyor having a top surface and a leading edge that is extended to an extended position and retracted to a retracted position by a belt movement mechanism;

a container cradle configured to hold the container in a loading orientation in which the face will open to the side, and in which the conveyor, when the leading edge is in the extended position, will extend from outside the container into the container through the open face;

wherein the container cradle is tiltable between a container receiving position in which the cradle will hold the container in a transport orientation with the open face upward, and a cradle loading position in which the cradle will hold the container in the container loading orientation with the open face to the side for loading, and a side wall of the container provides a surface on which the items are loaded, and the top surface of the conveyor extends substantially parallel to the side wall;

a belt movement mechanism that retracts the leading edge of the belt conveyor while the endless belt is running to deliver the items from the conveyor into the container in a layer as the leading edge retracts; and a height regulator that incrementally moves the cradle down after the leading edge is retracted and before the leading edge extends to allow the leading edge to be extended into the container while clearing items already contained therein, while maintaining the top surface of the conveyor substantially parallel to the side wall of the container.

2. The apparatus of claim 1 further comprising a cradle cover that is positioned to incrementally cover the open face of the container in the loading position as the height regulator incrementally moves the cradle down, wherein the cover includes an inner surface that slides when frictionally engaged by the items in the container to diminish relative movement between the items and the inner surface.

3. The apparatus of claim 2 further comprising a container transport surface that extends beneath the cradle, and has a surface suitable for conveying containers in the transport orientation to the cradle.

4. An apparatus for loading items into a container having an open face and a side wall, comprising:

an endless belt conveyor having a leading edge of the moving belt that moves between an extended position and a retracted position;

a cradle that holds the container in a loading orientation with the open face sideways and the side wall substantially horizontally disposed below the open face, such that the conveyor will project from outside the container through the open face into the container, along a path that is substantially parallel to the side wall, when the leading edge is in the extended position;

a delivery system that retracts the leading edge of the conveyor toward the retracted position while moving the belt of the conveyor to deliver a layer of the items into the container as the leading edge is retracting, then subsequently extending the leading edge of the conveyor to the extended position; and a cradle height regulator that incrementally moves the cradle down in the loading orientation after the conveyor has delivered the layer of the items, and positions the container for delivery of another layer of items on top of the layer of items in the container, with the side wall maintained substantially parallel to the path along which the conveyor extends.

5. The apparatus of claim 4 wherein the endless belt conveyor includes a downwardly inclined portion that forms a trough for distribution of the items transversely across the belt.

6. The apparatus of claim 4 wherein the cradle and cradle height regulator further include a frame that shifts the cradle downwardly in the loading orientation without tilting the cradle.

7. An apparatus for loading items in layers into a container having an open face, comprising:

a container transport surface on which the container is conveyed in a transport orientation with the open face upward;

a tiltable cradle, over the container transport surface, for receiving and holding the container in the transport orientation;

a tilting mechanism that tilts the container from the transport orientation to a loading orientation in which the open face opens sideways;

an endless belt conveyor having a leading edge that moves along a path of movement from a retracted position outside the container, through the open face into the container to an extended position when the container is in the loading orientation;

a leading edge mover within the endless belt conveyor that extends the leading edge of the conveyor to the extended position and retracts the leading edge back toward the retracted position while the conveyor belt is moving to deliver a layer of items in the container as the leading edge retracts; and a height adjuster that moves the cradle down after the layer of items is delivered in the container, without tilting the cradle, to provide clearance for delivering a subsequent layer of items into the container.

8. The apparatus of claim 7 wherein the tilting mechanism comprises a frame with a pair of side members each of which is held above the transport surface by a pivotally mounted leg, the height adjuster moves the cradle along the side members, and the tilting mechanism pivots the cradle from a first position in which the side members are substantially parallel to the transport surface and the container is in the transport orientation, to a second position in which the side members are substantially upright and the container is in the loading orientation.

9. The apparatus of claim 8 wherein the cradle further comprises an elevator that lifts the container away from the transport surface when the container is in the transport orientation with the cradle in the first position.

10. The apparatus of claim 7, further comprising a retaining wall that incrementally advances relative to the open face of the container as the height adjuster moves the container down, wherein the retaining wall has a slidable surface that diminishes relative movement between the slidable surface and the items in the container.

11. An apparatus for loading items in layers into a container having an open face, comprising:

a container transport surface on which the container is conveyed in a transport orientation with the open face upward;

a tiltable cradle, over the container transport surface, for receiving and holding the container in the transport orientation;

a tilting mechanism that tilts the container from the transport orientation to a loading orientation in which the open face opens sideways;

an endless belt conveyor having a leading edge that moves from a retracted position outside the container, through the open face into the container to an extended position when the container is in the loading orientation;

a leading edge mover within the endless belt conveyor that extends the leading edge of the conveyor to the extended position and retracts the leading edge back toward the retracted position while the conveyor belt is moving to deliver a layer of items in the container as the leading edge retracts; and a height adjuster that moves the cradle down after the layer of items is delivered in the container to provide clearance for delivering a subsequent layer of items into the container; and a pressure sensitive member underneath the conveyor, that senses when a bottom surface of the conveyor encounters pressure exceeding a preselected value.

12. An apparatus comprising:

a container having an opening facing sideways through which items are to be loaded into the container in layers from an endless belt conveyor;

a height adjustment mechanism that lowers the container relative to the conveyor for loading sequential layers of the items into the container;

a continuous belt conveyor having a leading edge that moves between an extended position in which the conveyor projects through the opening into the container, and a retracted position in which the conveyor is retracted from the container through the opening, and the apparatus includes a belt movement mechanism around which the continuous belt extends, that moves the belt between the extended and the retracted position; and a delivery device that delivers the items to the belt conveyor, wherein the continuous belt conveyor has a top surface that is inclined downwardly in a collection area to form a trough in which the items may collect to spread the items transversely across the top surface.

13. The apparatus of claim 12 wherein the belt inclines downwardly toward a rearmost roller to form the trough in which the items may collect and spread transversely across the belt.

14. The apparatus of claim 12 wherein the items are fruit, and the container is a fruit bin having flat walls.

15. The apparatus of claim 12 wherein the height adjustment mechanism further comprises an incremental movement regulator that incrementally lowers the container relative to the conveyor, without tilting the container, after the conveyor has been at least partially retracted, to provide clearance for loading a subsequent layer of items into the container.

16. The apparatus of claim 12 further comprising an item distributor that spreads the items out across the conveyor.

17. The apparatus of claim 16 wherein the item distributor comprises a plurality of rotating brushes that direct the items in a plurality of directions as the items move over the brushes, and a collection trough formed by the continuous conveyor belt and into which the items move from the brushes.

18. The apparatus of claim 12, wherein the endless belt conveyor comprises a belt that travels around a plurality of rollers, and at least two of the rollers change position as the leading edge of the conveyor moves between the extended and retracted positions.

19. The apparatus of claim 18 wherein one of the two rollers that change position includes a tensioning roller that changes position to maintain a substantially constant tension in the continuous belt as the leading edge moves between the extended and retracted positions.

20. The apparatus of claim 18 wherein the plurality of rollers includes a forward roller and a stationary rearward roller, a stationary intermediate roller between the forward and rearward rollers, and a movable tensioning roller between the forward and rearward rollers, wherein the continuous belt extends around the forward and rearward rollers, and changes direction around the intermediate and tensioning rollers, and the belt movement mechanism comprises the forward roller, which is movable to move the leading edge of the conveyor between the extended and retracted positions, and the tensioning roller changes position as the forward roller moves to maintain a substantially constant tension in the continuous belt.

21. The apparatus of claim 12 further comprising a tilting mechanism that tilts the container between a transport orientation wherein the opening faces upward, and a loading orientation wherein the opening faces sideways, and the conveyor is positioned to project through the opening when the container is in the loading orientation, but the conveyor cannot project through the opening when the container is in the transport position.

22. The apparatus of claim 21 further comprising aligned rollers on which the container can move, in the transport orientation, from an upstream position to the height adjustment mechanism.

23. The apparatus of claim 21 wherein the height adjustment mechanism further comprises a cradle into which the container is received, and the cradle moves the bin substantially vertically without tilting or moving on an incline.

24. The apparatus of claim 23 wherein the cradle further comprises an elevator that elevates the container in the transport orientation.

25. An apparatus comprising:

a container having an opening facing sideways through which items are to be loaded into the container in layers from an endless belt conveyor;

a height adjustment mechanism that lowers the container relative to the conveyor for loading sequential layers of the items into the container;

a continuous belt conveyor having a leading edge that moves between an extended position in which the conveyor projects through the opening into the container, and a retracted position in which the conveyor is retracted from the container through the opening, and the apparatus includes a belt movement mechanism around which the continuous belt extends, that moves the belt between the extended and the retracted position; and a pressure sensitive member that senses pressure against a bottom surface of the conveyor, and sends a signal to the height adjustment mechanism to lower the container relative to the conveyor.

26. An apparatus comprising:

a container having an opening facing sideways through which items are to be loaded into the container in layers from an endless belt conveyor;

a height adjustment mechanism that lowers the container relative to the conveyor for loading sequential layers of the items into the container;

a continuous belt conveyor having a leading edge that moves between an extended position in which the conveyor projects through the opening into the container, and a retracted position in which the conveyor is retracted from the container through the opening, and the apparatus includes a belt movement mechanism around which the continuous belt extends, that moves the belt between the extended and the retracted position;

wherein the height adjustment mechanism further comprises an incremental movement regulator that incrementally lowers the container relative to the conveyor, after the conveyor has been at least partially retracted, to provide clearance for loading a subsequent layer of items into the container; and wherein the incremental movement regulator lowers the container a preselected distance, then after the leading edge of the conveyor is moved into the extended position, raises the container until a pressure sensitive member detects a pressure against a bottom surface of the conveyor that exceeds a preselected value, and then lowering the container again.

27. A apparatus for loading fruit into a bin, comprising:

a bin having an open face through which the fruit is to be loaded into the bin, and a bottom and side walls which can retain fruit;

a bin conveyor on which the bottom of the bin moves to transport the bin from an upstream position to a bin cradle, which receives the bin in a transport orientation in which the open face of the bin faces up;

a tilting mechanism that tilts the bin from the transport orientation to a tilted orientation in which the open top of the bin faces sideways and a side wall of the bin is in a substantially horizontal loading position on to which the fruit can be loaded in layers;

an endless belt fruit conveyor with a leading edge that moves along a substantially horizontal path of movement substantially parallel to the side wall in the loading position, between an extended position in which the fruit conveyor projects through the opening into the bin with the bin in the loading orientation, and a retracted position in which the fruit conveyor does not project through the opening into the bin; and a height adjustment mechanism that moves the bin substantially vertically to vary a height of the bin relative to the conveyor without tilting the bin; and a trough formed by the conveyor belt transverse to the path of movement of the conveyor belt, in which trough fruit can collect for spreading transversely across the conveyor.

28. The apparatus of claim 27, wherein the height adjustment mechanism incrementally increases a relative height at which the conveyor delivers fruit through the open face of the bin.

29. The apparatus of claim 28 wherein the height adjustment mechanism incrementally lowers the bin to increase the relative height at which the conveyor delivers fruit through the open face of the bin to load the fruit in layers on the side wall.

30. The apparatus of claim 29 wherein the height adjustment mechanism comprises a cradle into which the bin is conveyed on the bin conveyor, and a bin elevator that raises the bin in the transport orientation in the cradle relative to the bin conveyor.

31. The apparatus of claim 29 further comprising a stationary bin cover having a movable surface that reduces relative movement between the cover and bin, and the bin cover is positioned to close the bin opening as the height adjustment mechanism lowers the bin in the loading orientation.

32. The apparatus of claim 31 wherein the movable surface of the bin cover is an endless flexible belt.

33. An apparatus for loading fruit into a fruit bin having an open face, with minimal damage to the fruit, comprising:

a bin conveyor comprising a plurality of side-by-side rollers having a rotational axis transverse to a direction of movement of the bin along the conveyor, wherein the bin conveyor includes an upstream section, a bin cradle section, and a downstream section;

a rectangular bin having a flat bottom and a plurality of flat walls that define the open face;

a cradle over the bin conveyor, wherein the cradle moves between a bin receiving position and a bin loading position, and the cradle includes a bin elevator having bin engaging members that lift and lower the bin in the cradle relative to the conveyor with the cradle in the bin receiving position;

a frame that carries the cradle, wherein the frame includes elongated side bars that are substantially parallel to the bin conveyor when the cradle is in the bin receiving position, and substantially perpendicular to the bin conveyor when the cradle is in the bin loading position, and the frame includes an externally threaded rotatable rod extending along at least one of the side bars wherein the rod mates with an internally threaded member on the cradle that moves the cradle longitudinally along the side bars as the rod rotates, for moving the bin along the side bars without tilting the bin;

further wherein the frame is pivotally mounted to the bin conveyor for movement of the cradle between the bin receiving position and the bin loading position;

a power member connected to the frame that pivots the frame for movement of the cradle between the bin receiving position and the bin loading position;

a substantially flat endless belt fruit conveyor that is substantially as wide as but fits through the open face of the bin that is to be filled, wherein the fruit conveyor is extendable from outside the bin through the bin opening to a fruit delivery initiation position with the cradle in the bin loading position, and retractable to a cradle repositioning position, and the endless belt fruit conveyor has an upper surface that defines a transverse trough in which fruit deposited on the endless belt fruit conveyor can spread out transversely across the conveyor;

a fruit loading regulator barrier extending along a leading edge of the fruit conveyor, wherein the loading regulator barrier moves between a stop position that prevents delivery of fruit from the fruit conveyor, and a delivery position in which fruit is free to move from the conveyor into the bin;

an incremental cradle height adjustment mechanism that incrementally lowers a height of the cradle, with the cradle in the bin loading position, after the fruit conveyor is retracted to the cradle repositioning position;

a stationary cover positioned to incrementally cover the cradle as the height adjustment mechanism lowers the cradle, wherein the cover has a movable surface that minimizes relative movement between the cover and fruit in the bin as the cradle is lowered; and a plurality of fruit distribution brushes that distribute fruit across a width of the fruit conveyor.

34. The apparatus of claim 33 further comprising a bin that rides on the bin conveyor, wherein the bin comprises a rectangular box with flat walls, an open top, and a closed bottom, and a plurality of beams extend across an exterior surface of the closed bottom to support the bin on the bin conveyor, wherein the bin engaging members of the cradle include arms that project underneath bin to engage and lift the bin in the cradle.

35. A method of loading items into a container comprising the steps of:

providing a container having an open face through which the items are to be loaded in layers into the container;

providing an endless belt conveyor having a leading edge that moves between an extended position and a retracted position;

positioning the container in a loading orientation with the open face of the container directed to the side;

extending a leading edge of the endless belt conveyor from outside the bin through the open face of the bin into the container to an item delivery position, and delivering items into the bin by moving an endless belt of the endless belt conveyor;

retracting the leading edge of the conveyor as the items are being delivered to form a layer of the items on a wall of the container as the leading edge of the conveyor is retracted;

lowering the container relative to the conveyor after forming the layer of the items then extending the leading edge of the conveyor through the open face of the bin into the container to the item delivery position, and delivering items into the bin while retracting the item conveyor to form another layer of the items in the container on top of the layer of items already in the container; and wherein lowering the container after delivering the layer of items comprises lowering the container a predetermined vertical amount without tilting the container, then extending the leading edge of the conveyor into the container, then raising the container relative to the conveyor until an item in the layer of items contacts the conveyor, then lowering the container a second predetermined amount to provide a clearance distance between the conveyor and the item that contacted the conveyor.

36. A method of loading fruit items into a container, comprising:

providing a fruit bin container having an open top face through which the items are to be loaded in layers into the container and a side wall surface on which the items are to be loaded;

providing an endless belt conveyor having a leading edge that moves between an extended position and a retracted position;

positioning the container in a loading orientation with the open top face of the container directed to the side, and the side wall surface substantially horizontal;

extending a leading edge of the endless belt conveyor from outside the bin through the open face of the bin into the container to an item delivery position, and delivering items into the bin by moving an endless belt of the endless belt conveyor;

retracting the leading edge of the conveyor as the items are being delivered to form a layer of the items on a wall of the container as the leading edge of the conveyor is retracted; and positioning the container in a transport orientation with the side wall surface substantially vertical.

37. The method of claim 36 further comprising lowering the container substantially vertically relative to the conveyor after forming the layer of the items, then extending the leading edge of the conveyor through the open face of the bin into the container to the item delivery position, and delivering items into the bin while retracting the item conveyor to form another layer of the items in the container on top of the layer of items already in the container.

38. The method of claim 37 wherein lowering the container comprises lowering the container a distance substantially the same as a height of the layer of items.

39. The method of claim 37 wherein multiple sequential flat layers of items are delivered into the container from the retracting leading edge of the conveyor.

40. The method of claim 37 further comprising spreading the items across a width of the item conveyor before delivering the items to the container.

41. The method of claim 37 wherein the conveyor is extended through the open face substantially parallel to the side wall.

42. The method of claim 37 wherein positioning the container in a loading orientation comprises positioning the container with the side wall surface substantially horizontal, and the endless belt conveyor is extended through the open face of the bin substantially parallel to the side wall surface.

43. The method of claim 37 further comprising incrementally covering the open face of the container, after each layer of items is delivered into the container, to cover the open face to a height that retains items in the container that have already been delivered.

44. The method of claim 43 wherein incrementally covering the open face further comprises providing a stationary cover having a movable surface that moves downwardly as the container is lowered to reduce frictional engagement between the items and the cover, and the step of lowering the container relative to the conveyor incrementally covers the open face of the container.

45. The method of claim 37 wherein providing the container comprises providing the container on a container transport in a transport orientation with the open face opening upward, then tilting the container to the loading orientation with the open face opening sideways, and extending the leading edge of the conveyor through the open face with the container in the loading orientation.

46. The method of claim 45 wherein tilting the container comprises lifting the container away from the container transport before tilting the container to the loading orientation.

47. The method of claim 46 wherein providing the container comprises transporting the container in the loading orientation on the container transport from a pre-loading location to a loading location, where the container is lifted away from the transport surface and tilted to the loading position.

48. The method of claim 47 wherein, after a predetermined number of layers of the items have been delivered into the container, the container is tilted back to the loading orientation, lowered to the container transport, and transported on the container transport to a downstream location.

49. A method of loading fruit into a container with an open face, comprising:

providing the container on a transport surface, wherein the container is a transport orientation with the open face directed upwardly;

moving the container in the transport orientation on the transport surface from a pre-loading location to a loading location;

tilting the container from the loading location into a loading position in which the container is held in a loading orientation with the open face directed sideways;

providing an endless belt conveyor having a leading edge that moves between an extended position and a retracted position, wherein the endless belt conveyor has an endless belt that moves to deliver items from the endless belt;

with the bin in the loading orientation, extending the leading edge of the conveyor through the open face of the bin into the container to an item delivery position, and delivering items into the bin from the moving endless belt;

retracting the leading edge of the conveyor as the items are being delivered to form a layer of the items in the container, wherein a rate of delivery of the conveyor is substantially the same as a rate of retraction of the conveyor;

lowering the container in the loading orientation relative to the conveyor, after forming the layer of the items, then extending the leading edge of the conveyor through the open face of the bin into the container to the item delivery position, and delivering items into the bin while retracting the item conveyor to form another layer of the items in the container on top of the layer of items already in the container, wherein the step of lowering the container after delivering the layer of items comprises lowering the container a predetermined amount, then extending the leading edge of the conveyor into the container, then raising the container relative to the conveyor until an item in the container contacts the conveyor, then lowering the container to provide a clearance between the conveyor and the item that contacted the item conveyor;

repeating the step of lowering the container and delivering a layer of items into the container until a desired number of layers of items have been delivered;

providing an item delivery regulator at a leading edge of the conveyor, and using the regulator to prevent the delivery of items from the conveyor until the conveyor is extended to the item delivery position;

incrementally covering the open face of the container after each layer of items is delivered into the container by advancing a cover to a height of a top layer in the container after the item conveyor has been retracted, wherein the cover has a movable surface that neutralizes frictional engagement and relative movement between the cover and an item abutting against the cover;

after the desired number of layers of items have been delivered, tilting the container from the loading location to the transport location; and transporting the container on the transport surface from the loading location to a storage location.

* * * * *

UNITED STATES PATENT AND TRADEMARK OFFICE

CERTIFICATE OF CORRECTION

PATENT NO. : 5,794,415

DATED : August 18, 1998

INVENTOR(S) : Huff et al.

It is certified that error appears in the above-identified patent and that said Letters Patent is hereby corrected as shown below:

| Col./Line | Error Reads | Should Read |
|---|---|---|
| 4/60 | V71 | 71 |
| 10/23 | I claim: | We claim: |
| 12/10 | the container. | the bin. |
| 16/23 | container comprising | container, comprising |
| 17/36 | substantiallv | substantially |

Signed and Sealed this

Tenth Day of April, 2001

*Attest:*

Nicholas P. Godici

NICHOLAS P. GODICI

*Attesting Officer*

*Acting Director of the United States Patent and Trademark Office*